United States Patent [19]

Shiau

[11] Patent Number: 4,967,325

[45] Date of Patent: Oct. 30, 1990

[54] VARIABLE FOCUSING FLASHLIGHT

[76] Inventor: Shoei-Shuh Shiau, No. 10, Alley 1, Lane 551, Sec. 1, Wan-Shou Rd., Guei-Shan Hsiang, Taoyuan Hsien, Taiwan

[21] Appl. No.: 500,088

[22] Filed: Mar. 27, 1990

[51] Int. Cl.[5] ..... F21L 7/00

[52] U.S. Cl. ..... 362/188; 362/205; 362/203

[58] Field of Search ..... 362/188, 203, 205

[56] References Cited

U.S. PATENT DOCUMENTS 4,725,932 2/1988 Gammache ..... 362/205

4,819,141 4/1989 Maglica et al. ..... 362/205

*Primary Examiner*—Carroll B. Dority

*Attorney, Agent, or Firm*—Darby & Darby

[57] ABSTRACT

A flashlight includes a flashlight head assembly, a barrel, and a lamp base. The lamp base is fixed inside the head assembly and is rotatably engaged to the barrel. When the head assembly is rotated relative to the barrel, a flashlight bulb fixed to said lamp base moves axially away from or towards a lens attached to the head assembly, thus varying the focusing distance of the bulb. The barrel serves as a contact between the negative terminal of a battery and a terminal end of the flashlight bulb. A second terminal end of the flashlight bulb is connected to an elastic spring whose base is fixed on a metal post. The rotation of the head assembly relative to the barrel can accordingly compress or expand the elastic spring. The elastic spring can thus urge the metal post to contact the positive terminal of the battery.

4 Claims, 3 Drawing Sheets

VARIABLE FOCUSING FLASHLIGHT

BACKGROUND OF THE INVENTION

This invention relates to a flashlight, more particularly to a flashlight wherein the focusing distance of the flashlight bulb can be varied, thus producing various dispersions of the reflected lamp beam.

Variable dispersion flashlights are known in the art. An example is a flashlight with a slidable push button switch that can urge the lamp base to axially move towards or away from the flashlight lens. A disadvantage of this flashlight is in the structure of its switching circuit. For this flashlight, the conducting strips have to be frequently bent, making them very susceptible to breakage at the folded edges.

A second example of a flashlight having variable dispersion is U.S. Pat. No. 4,577,263, which is a miniature flashlight wherein the head assembly is threaded to the barrel. The rotation of the head assembly with respect to the barrel translates the head assembly towards the tail cap and moves the reflector with respect to the bulb to achieve varying dispersions of the reflected lamp beam. Further rotation of the head assembly is possible until a side conductor of the flashlight no longer contacts the barrel, thereby disconnecting the power supply from one terminal of the lamp. A disadvantage of this flashlight is that its length is not constant. The length of the flashlight in an ON state is longer than the original length of the flashlight when not in use. This discrepancy in length produces a gap where foreign substances may accumulate.

SUMMARY OF THE INVENTION

Therefore, the object of this invention is to provide a variable dispersion flashlight with a constant length.

Accordingly, a flashlight of this invention comprises a flashlight head assembly, a barrel, and a lamp base. The lamp base is fixed inside the head assembly and is rotatably engaged to the barrel. When the head assembly is rotated relative to the barrel, the flashlight bulb moves away from or towards a lens attached to the head assembly, while the flashlight maintains a fixed length The barrel serves as a contact between the negative terminal of a battery and a terminal end of the flashlight bulb. A second terminal end of the flashlight bulb is connected to an elastic spring whose base is fixed on a metal post. The rotation of the head assembly relative to the barrel can accordingly compress or expand the elastic spring. The elastic spring thus urges the metal post to contact the positive terminal of the battery. A closed current loop is thus formed for supplying power to the flashlight bulb.

BRIEF DESCRIPTION OF THE DRAWINGS

Other features and advantages of this invention will become apparent in the following detailed description of the preferred embodiment with reference to the accompanying drawings, in which.

DETAILED DESCRIPTION OF THE PREFERRED EMBODIMENT

Figure 1:
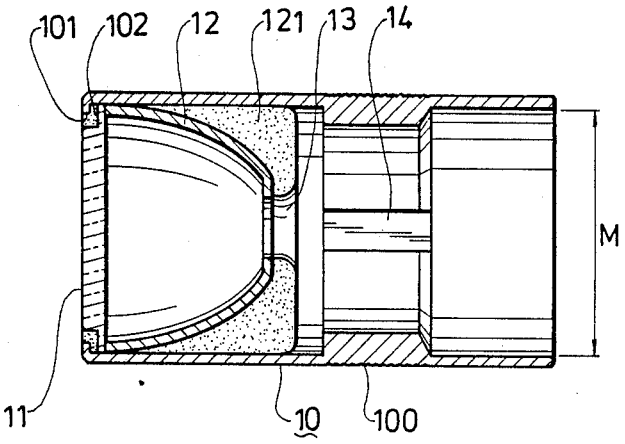
FIGS. 1, 2, 3 are sectional views of parts of a flashlight according to this invention.
Figure 3:
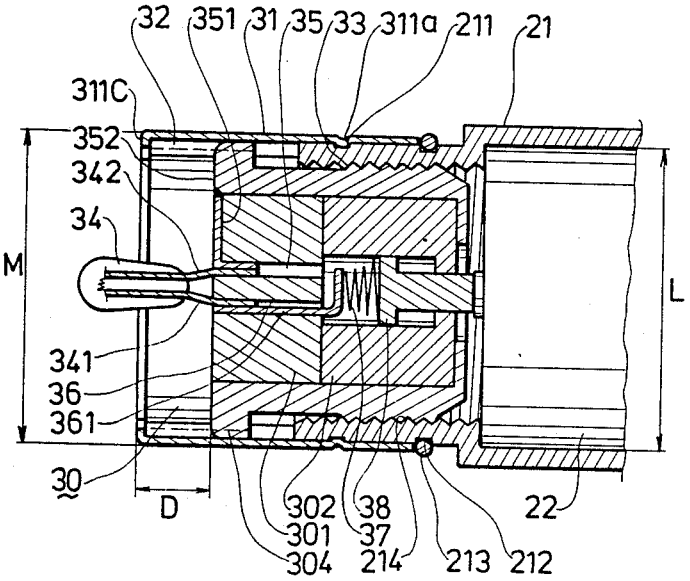
Figure 2:
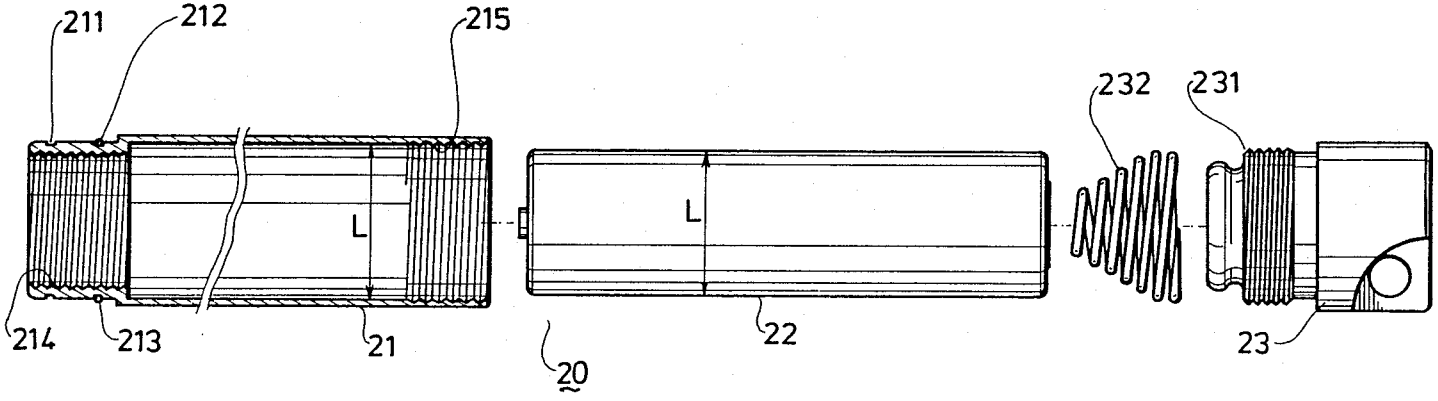

Referring to the accompanying figures, a flashlight according to this invention comprises a flashlight head assembly 10 (as seen in FIG. 1), a barrel 20 (as seen in FIG. 2), and a lamp base 30 (as seen in FIG. 3).

The head assembly 10 is substantially cylindrical in shape and has two open ends. The outer surface of the head assembly 10 has an embossed pattern 100 formed to serve as a handling portion. A lens 11 is attached to the first open end 101 of the head assembly 10 (the second open end is designated as M). The peripheral edge of the lens 11 is connected to a parabolic reflector 12. A water resistant plastic base 121 is disposed in the space between the head assembly 10 and the reflector 12. A water resistant plastic ring 102 is press fitted in a space between the lens 11 and the head assembly 10 at the first open end 101. The reflector 12 has a central hole 13 formed on its apex. An engaging opening 14 is communicated with the central hole 13.

The barrel 20 comprises a battery housing 21 and a tail cap 23. The battery housing 21 is a conductor having a cylindrical wall. The hollow space inside is designated as L. At least one battery 22 is received inside the hollow space L. The battery housing 21 has two annular grooves 211, 212, formed on one end of the outer wall of the battery housing 21. The annular groove 212 receives a sealing ring 213. Spiral grooves 214, 215, are formed on the inner wall at each end of the battery housing 21 for engaging with the head assembly 10 and the tail cap 23, respectively. The tail cap 23, which is also a conductor, comprises external screw threads 231 for engaging with the spiral grooves 215 of the battery housing 21, and a conducting spring 232 for contacting with the negative terminal of the battery 22.

Figure 4:
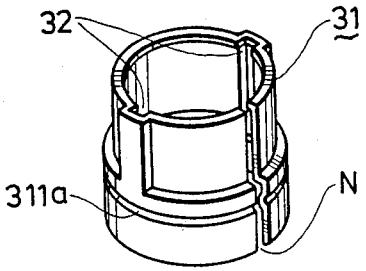
FIG. 4 is a perspective view of an element of the part shown in FIG. 3.
Figure 5:
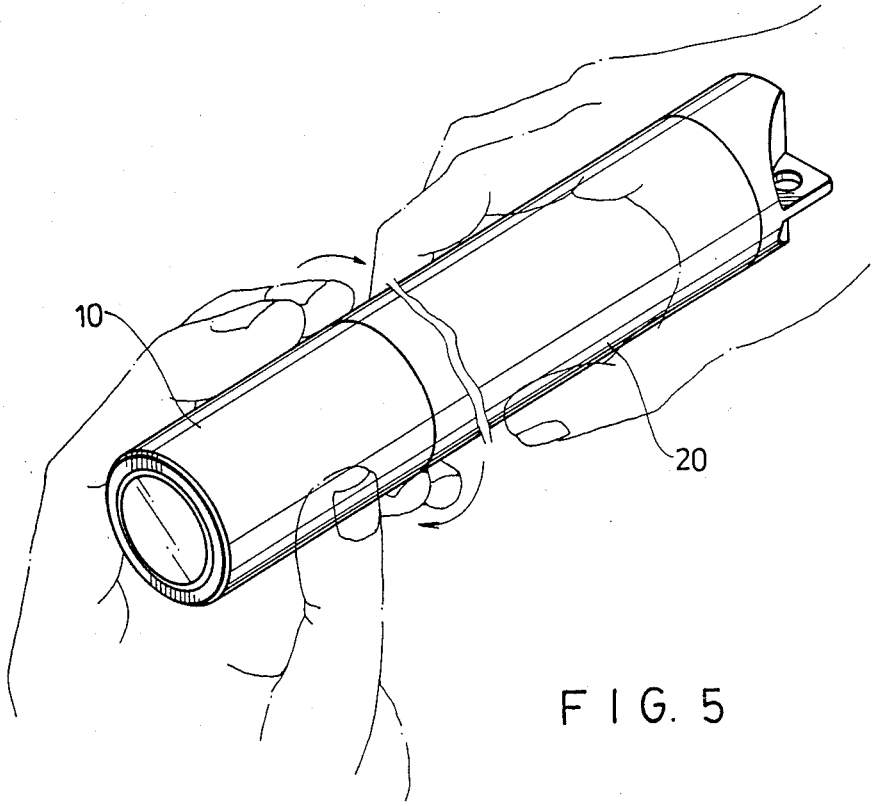
FIG. 5 is an illustration of the preferred embodiment in use.

Referring to FIGS. 3, 4, a sleeve member 31 which is made of a flexible material has an axial notch N formed therein. The sleeve member 31 further comprises an annular projection 311*a* projecting inwardly and radially for engaging with the annular groove 211 of the battery housing 21. The sleeve member 31 also comprises a pair of outwardly projecting axial projections forming a pair of axial keyways 32. The lamp base 30 comprises screw threads 33 formed on the external surface of a conducting shell member 352 for engaging with the spiral grooves 214 of the battery housing 21. A bulb 34 has conducting terminals 342, 341 received by terminal grooves 35, 36, respectively. Metal conducting strips 351, 361 are similarly received by the terminal grooves 35, 36, respectively. One end of the conducting strip 351 contacts the conducting shell member 352, while one end of the metal strip 361 is fixed to an elastic spring 37. The base of the elastic spring 37 is fixed on a slidably disposed metal post 38. Insulating members 301, 302 prevent any short circuit from occurring. The lamp base 30 further comprises a pair of keys 304 which are received by the keyways 32 of the sleeve member 31. The lamp base 30 is rotatably engaged to the battery housing 21 and the rotation of the lamp base 30 allows the keys 304 to move along the keyways 32. The sleeve member 31 has an inwardly and radially projecting flange end 311*c* which obstructs the movement of the keys 304 to prevent the battery housing 21 from disengaging with the sleeve member 31.

During assembly, the sleeve member 31 is sleeved onto one end of the battery housing 21 and the external screw threads 33 are engaged with the spiral grooves 214. The annular projection 311*a* is press fitted to the annular groove 211. The battery 22 is disposed inside the battery housing 21. The external screw threads 231 of the tail cap 23 are engaged to the spiral grooves 215 of the battery housing 21. The conducting spring 232 is then compressed by the battery 22. If the battery 22 does not contact the conducting spring 232, the flashlight will not function.

After the lamp base 30 has been engaged to the battery housing 21, the end of the barrel 21 with the sleeve member 31 is received by the engaging opening 14 of the head assembly 10. The notch N of the sleeve member 31 is forced to close due to the difference in diameters between the engaging opening 14 and the diameter of the open end M. Waterproofing is provided for in the flashlight by the plastic ring 102, the plastic base 121 and the sealing ring 213.

When in operation, the keys 304 initially contact the flange end 311*c*. The metal post 38 is not yet in contact with the positive terminal of the battery 22. The battery housing 21 is then rotated relative to the head assembly 10. The rotation enables the keys 304 to move away from the flange end 311*c*. The metal strip 361 pushes the elastic spring 37, which in turn urges the metal post 38 to contact the positive terminal of the battery 22.

The external screw threads 33 and the spiral grooves 214 make possible the axial movement of the bulb 34, so that the bulb 34 can pass through the central hole 13 of the reflector 12. The movement of the bulb 34 varies the focusing distance and achieves various dispersions of the reflected lamp beam.

The terminal end 341 of the bulb 34 is connected to the positive terminal of the battery 22 through the metal strip 361, the elastic spring 37 and the metal post 38. The terminal end 342 of the bulb 34 is connected to the negative terminal of the battery 22 through the conducting spring 232, the tail cap 23, the battery housing 21, the spiral grooves 214, the external screw threads 33 and the metal strip 351. Adjustment of the lamp beam is possible until the keys 304 are displaced from the flange member 311*c* by a maximum displacement D. At this displacement, the elastic spring 37 is compressed to its shortest length.

When the head assembly 10 is rotated such that the keys 304 reach the flange end 311*c*, the elastic spring 37 attains its original length and the metal post 38 is not urged to contact the positive terminal of the battery 22, thereby cutting off the power supply to the bulb 34. Applying additional torque in order to further rotate the head assembly 10 in this direction will result in the disengagement of the sleeve member 31 from the battery housing 21.

While the present invention has been described in connection with what is considered the most practical and preferred embodiment, it is understood that this invention is not limited to the disclosed embodiments, but is intended to cover various arrangements included within the spirit and scope of the broadest interpretation so as to encompass all such modifications and equivalent arrangements.

I claim:

1. A flashlight, comprising:

a flashlight head assembly having a transparent surface at one end and an engaging opening at an opposite end;

a barrel for receiving a cell means, said barrel being rotatably engaged with said flashlight head assembly at said engaging opening;

a flashlight bulb;

a lamp base having a first portion with said flashlight bulb being fixed on one end of said first portion, said first portion being received by said engaging opening of said flashlight head assembly, and a second portion threadedly engaged with said barrel; and a key and a keyway assembly, separately disposed between said first portion of said lamp base and said flashlight head assembly, thereby the rotation of said flashlight head assembly will rotate said lamp base relative to said barrel, and said threaded engagement between said second portion of said lamp base and said barrel will allow axial movement of said lamp base relative to said barrel, thus allowing the distance between said flashlight bulb fixed on said lamp base and said transparent surface of said flashlight head assembly to be varied.

2. A flashlight as claimed in claim 1, wherein said said barrel and said lamp base are made of a conducting material and are electrically connected to a charged first terminal of the cell means; said flashlight further comprising a metal post and an elastic spring having a base fixed to said metal post, said elastic spring being compressed when said flashlight bulb moves away from said transparent surface of said flashlight head assembly and urges said metal post to contact an oppositely charged second terminal of the cell means; said flashlight bulb comprises a first conducting terminal electrically connected to said lamp base and a second conducting terminal electrically connected to said elastic spring.

3. A flashlight as claimed in claim 2, further comprising insulating members disposed inside said lamp base to prevent short circuits.

4. A flashlight as claimed in claim 3, wherein said flashlight head assembly further comprises:

a reflector connected to the peripheral edges of said transparent surface;

a water resistant plastic ring press fitted in a space formed between said transparent surface and said flashlight head assembly; and a water resistant plastic base disposed in a space formed between said reflector and said flashlight head assembly;

whereby said water resistant plastic ring and said water resistant plastic base achieve a waterproofing effect.

* * * * *